US007377784B2

(12) United States Patent
Ryland

(10) Patent No.: US 7,377,784 B2
(45) Date of Patent: May 27, 2008

(54) SYSTEMS AND METHODS FOR DEVELOPING CORRECT MECHANICS OF A SWIMMING FLIP TURN

(76) Inventor: David E. Ryland, 1708 E. Abbedale Ln., Sandy, UT (US) 84092

( * ) Notice: Subject to any disclaimer, the term of this patent is extended or adjusted under 35 U.S.C. 154(b) by 551 days.

(21) Appl. No.: 11/109,223

(22) Filed: Apr. 18, 2005

(65) Prior Publication Data

US 2005/0255433 A1 Nov. 17, 2005

Related U.S. Application Data

(60) Provisional application No. 60/563,925, filed on Apr. 20, 2004.

(51) Int. Cl.
*A63B 69/12* (2006.01)

(52) U.S. Cl. ..... 434/254

(58) Field of Classification Search ..... 434/247, 434/254; 441/55, 73, 111; 482/129, 130
See application file for complete search history.

(56) References Cited

U.S. PATENT DOCUMENTS 3,140,550 A * 7/1964 Wayfield ..... 434/254
3,945,068 A * 3/1976 Carbonero ..... 441/56
4,529,192 A * 7/1985 Stites ..... 482/55
4,712,788 A * 12/1987 Gaudreau, Jr. ..... 482/54
5,033,735 A * 7/1991 Erickson ..... 482/39
5,098,085 A * 3/1992 Abboudi et al. ..... 482/70
5,354,253 A * 10/1994 Awbrey et al. ..... 482/111
5,487,713 A * 1/1996 Butler ..... 482/111
6,033,351 A * 3/2000 Sizemore et al. ..... 482/111
6,039,572 A * 3/2000 Meier et al. ..... 434/254
6,179,759 B1 * 1/2001 Tellone ..... 482/111
6,905,444 B2 * 6/2005 Milton ..... 482/55
6,960,086 B2 * 11/2005 Bergeron ..... 434/254
7,101,241 B2 * 9/2006 Monroe ..... 441/129
2007/0184947 A1 * 8/2007 Hruska, Jr. ..... 482/111

* cited by examiner

*Primary Examiner*—Kurt Fernstrom
(74) *Attorney, Agent, or Firm*—Kirton & McConkie; Michael F. Krieger

(57) ABSTRACT

Systems and methods for providing and using a teaching aid that enables swimmers to develop correct mechanics and movement patterns of a flip turn. A teaching aid is provided that functions to expedite the teaching and learning of proper flip turn mechanics by providing an object for a swimmer to place his/her hands on and press down for support, tactile feedback and spatial orientation as the swimmer learns to initiate and perform a proper flip turn. Utilization of the teaching aid allows a swimmer to feel and move through the proper mechanics of the flip turn, thereby expediting the swimmer's ability to perform the turn without assistance.

20 Claims, 15 Drawing Sheets

SYSTEMS AND METHODS FOR DEVELOPING CORRECT MECHANICS OF A SWIMMING FLIP TURN

RELATED APPLICATIONS

This application claims priority to U.S. Provisional Patent Application Ser. No. 60/563,925 filed Apr. 20, 2004, entitled SYSTEMS AND METHODS FOR DEVELOPING CORRECT MECHANICS OF A SWIMMING FLIP TURN, which is incorporated herein by reference.

BACKGROUND OF THE INVENTION

1. Field of the Invention

The present invention relates to developing correct mechanics of a swimming flip turn. In particular, the present invention relates to providing and using a teaching aid that enables swimmers to develop correct mechanics and movement patterns of a flip turn that is used, for example, in freestyle and backstroke swimming events.

2. Background and Related Art

Conventional techniques for teaching proper mechanics of a flip turn include explaining the mechanics to a swimmer or talking a swimmer through the mechanics of a flip turn. Such techniques are often met with confusion by the swimmer. For example, the name of the turn causes confusion because use of the word "flip" can imply a 360-degree rotation, while proper execution of the flip turn only requires a 180-degree rotation.

Beyond the misleading name, coaches and swimming instructors use a myriad of other terms, verbal cues and phrases to describe or explain the mechanics of the flip turn. They search for the words and/or phrases that will invoke the correct movement interpretation for the swimmer that they are currently instructing. Sample instructions may include: "Do a somersault" (which may also imply a 360-degree rotation). "Get your nose to your knees and use your hands as a point of stability." "Don't scull with your hands." "Do scull with your hands." "Push water over your head." "Push the water down." "As soon as your legs come up, bring your arms up toward your head." "Pretend you're throwing something over your shoulders." "Keep your arms at your sides, until your sides aren't there anymore." Such expressions represent a trial and error approach that can prove to be ineffective, or at the very least, slow in delivering the desired result.

Adding to the challenge of teaching proper mechanics is the fact that most swimmers who are new to the flip turn are also typically novice swimmers who have less feel or kinesthetic awareness in water as compared to a more experienced swimmer. Many swimmers become lost as they tumble around, losing sight and awareness of where they are and where they are going. They move body parts (most notably, hands and arms) in all directions to gain some level of balance and direction. In the end, although most will acquire some cognizant understanding from verbal cues and prompting, few swimmers execute proper mechanics of the turn from such preliminary or initial instructional techniques. Most times, after receiving verbal instruction, the swimmers are left to figure it out by themselves through continued trial and error within their daily practice sessions.

Pictures, videos and demonstrations can prove helpful, yet there are subtleties of movement, critical to proper execution of the flip turn, that are not only difficult to translate into language, but equally difficult to observe. Such subtleties include a quick, short, push-down on the water with one or both hands (while at the swimmer's side) just after the final arm pull (while heading into the wall of the pool) and the initial tuck of the head. This quick, short downward thrust of the hands serves as a counterbalance of sorts by holding the swimmer from sinking to an improper depth caused by the downward pushing weight of the hips and legs as they rise up and out of the water. This quick downward hand push also helps to throw the hips and legs over with increased velocity, and keeps the hands and arms where they need to be throughout the flip so as to position them over the swimmer's head at the moment the feet are positioned on the wall for an immediate streamlined push-off.

Hands-on teaching strategies (physically moving the swimmer through the proper mechanics of the turn) while effective, are rarely practical given the most common teaching/coaching scenarios. Such techniques require the coach or instructor to be in the water and of sufficient size and strength to manipulate the movements of the swimmer. Moreover, it is also uncommon for an entire class or team of swimmers to be in need of learning the turn at the same time. Rather, it is much more common that one or two new swimmers are in need of learning the turn or that an individual swimmer or two is in need of a refresher on proper technique. It is not desirable or practical for a coach or instructor to leave the rest of what is typically a sizable group in order to move a couple of swimmers through the proper mechanics of the flip turn.

Thus, while techniques currently exist that are used to instruct proper mechanics of performing a flip turn, challenges still exist. Accordingly, it would be an improvement in the art to augment or even replace current techniques with other techniques.

SUMMARY OF THE INVENTION

The present invention relates to developing correct mechanics of a swimming flip turn. In particular, the present invention relates to providing and using a teaching aid that enables swimmers to develop correct mechanics and movement patterns of a flip turn that is used, for example, in freestyle and backstroke swimming events.

Implementation of the present invention takes place in association with a teaching aid that functions to expedite the teaching and learning of proper flip turn mechanics by providing an object for a swimmer to place his/her hands and/or arms on and press down for support. The teaching aid provides tactile feedback and spatial orientation to the swimmer as he/she learns to initiate and perform a proper flip turn. Utilization of the teaching aid allows a swimmer to feel and move through the proper mechanics of the flip turn, prior to learning it (similar to use of training wheels to facilitate and assist learning to balance and ride a two wheel bike), thereby expediting the swimmer's ability to perform the turn without assistance.

In at least one implementation, the a teaching aid is provided for use in developing correct mechanics of a swimming flip turn, the teaching aid comprising a plurality of surface areas that are each at least as wide as a swimmer's hand width, wherein the surface areas are spaced a distance apart and located at a water depth from a top surface of the water to allow the swimmer to perform a swimming flip turn there between while the swimmer is in contact with the surface areas, the surface areas each being configured to receive a portion of the swimmer's hand for at least one of (i) support, (ii) tactile feedback and (iii) spatial orientation as the swimmer performs the swimming flip turn.

While the methods and processes of the present invention have proven to be particularly useful in the areas of teaching and developing proper mechanics for a flip turn used in association with the freestyle swimming stroke, those skilled in the art can appreciate that these methods and processes can also be used to teach and develop proper mechanics for a flip turn associated with other swimming events, including backstroke swimming events.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

Figure 1:
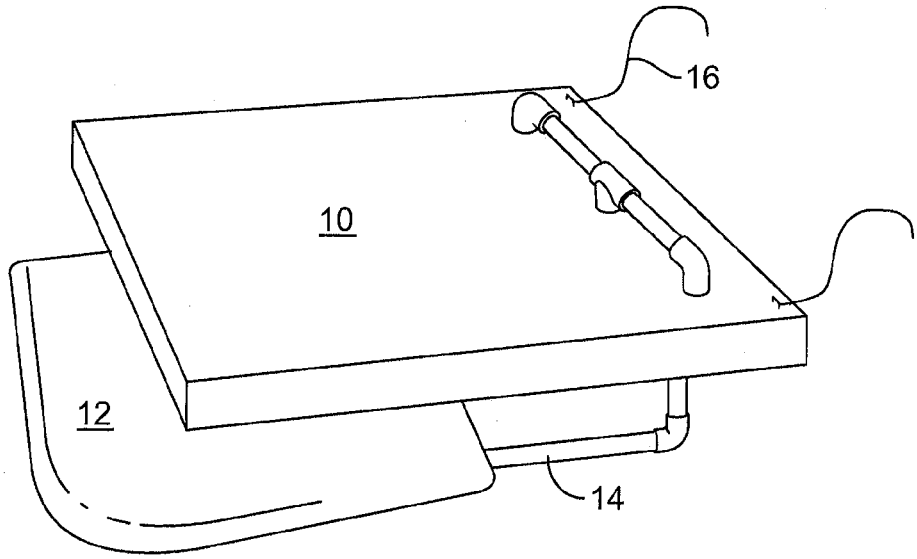
FIG. 1 illustrates a representative teaching aid that enables swimmers to develop correct mechanics and movement patterns of a swimming flip turn in accordance with an embodiment of the present invention.

The present invention relates to developing correct mechanics of a swimming flip turn. In particular, the present invention relates to providing and using a teaching aid that enables swimmers to develop correct mechanics and movement patterns of a flip turn that is used, for example, in freestyle and backstroke swimming events.

Embodiments of the present invention take place in association with a teaching aid or device that functions to expedite the teaching and learning of proper flip turn mechanics by providing a surface for a swimmer to place his/her hands on and press down for support, tactile feedback and spatial orientation as the swimmer learns to initiate and perform a proper flip turn. Utilization of the teaching aid allows a swimmer to feel and move through the proper mechanics of the flip turn, prior to learning it (similar to use of training wheels to facilitate and assist learning to balance and ride a two wheel bike), thereby expediting the swimmer's ability to perform the turn without assistance.

One or more platforms or surface areas of a teaching device are used to serve as hand and/or forearm placeholders and spatial reference points to keep the swimmer spatially oriented and positioned correctly throughout the flip turn. The teaching device is positioned in a swimming pool such that the platforms are at a distance from the pool wall and at a depth, angle and distance apart in the water to allow a right and left hand placement precisely where the swimmer's body and hands should be positioned at the initiation of a proper flip turn.

Utilization of a teaching aid in accordance with a representative embodiment includes allowing a swimmer to perform a progression of drills that enable them to learn the correct mechanics of the flip turn in step by step fashion beginning with a simple "standing somersault" drill. To execute this initial drill, the swimmer assumes a standing position (arms down at their sides) between the hand platforms somewhat forward of the platforms and toward the wall where they intend to turn. Facing this wall the swimmer reaches back with both hands, placing one on each hand platform, palms down with fingers pointing in the opposite direction of the wall they are facing. The swimmer then performs a simple "straight over" somersault in the water while keeping both hands positioned on the hand platforms throughout. As the feet and legs begin dropping toward the bottom of the pool at the completion of the rotation, the swimmer's head will rise up out of the water and the hands will ultimately lift off the hand platforms as the swimmer's feet drop to the bottom of the pool and the swimmers stands back up. This simple initial drill presents the swimmer with the valuable opportunity of feeling the correct positioning of the hands and arms during the rotational period of a proper flip turn. It also allows the swimmer to feel and maintain proper depth during the flip, proper distance from the wall from which to initiate the flip, and a proper straight "head over heels" rotation, as both hands are provided a solid surface upon which to press and balance as he/she flips over. It is, in fact, difficult for even the most novice swimmer to execute this initial drill incorrectly, or in a way that would not promote a good base level kinesthetic awareness of where their hands, arms and body should be located throughout a proper flip turn. Likewise, it is difficult to perform this initial drill without developing an almost immediate feeling of self confidence. After executing and feeling this initial standing somersault drill several times, the swimmer advances to a "standing flip to push off" drill which requires him/her to begin in the same exact position as the previous initial drill (standing, facing wall, with both hands on hand platforms), but this time as the swimmer rotates around, he/she works to "find" the wall with his/her feet for placement and subsequent streamlined "push off" on his/her back.

Embodiments of the present invention provide such advantages. Further, such platforms/surfaces of embodiments of the present invention serve as a tangible reference point for proper depth of foot placement on the wall and proper depth of the subsequent push off. Swimmers can be instructed to align their feet, hips and head at the same depth or level as the hand platforms just at the finish of their flip turn rotation to achieve a subsequent push off of proper depth and alignment. "Align your head, hips and feet at the same depth as the hand platforms just prior to pushing off and keep your hands on the hand platforms until you've reached this position. Then simply slide your hands off the hand platforms medially until they come together over your head and push off, stretching to a streamline position on your back".

After executing and feeling this drill several times, the swimmer advances to a "kick in" drill by assuming a prone or face down position level on the surface of the water, approx. 3 to 4 yards away from the wall where they intend to execute a flip turn. From this position, with both arms at their side, the swimmer begins to kick forward (head first) toward the wall directing himself/herself between the two extended platforms or surfaces. As the swimmer enters the area between the two extended platforms, he/she outwardly rotates both hands to a palms-down position with one hand over each platform while continuing to kick forward until their head reaches a distance from the wall of approximately one arm's length. At this point the swimmer settles both hands (palms down) onto the extended platforms and begins to tuck their head and flex at the hip while pressing or otherwise biasing downward on the platforms with both hands.

In the present example, the hands remain pressed against the hand platforms as the swimmer's hips and legs rise up out of the water and continue on over the swimmer's head toward the wall. As the swimmer's hips, legs and feet fall back into the water for the subsequent push-off, the swimmer is now positioned on his/her back, underwater, feet on the wall, knees bent with the hands still in the same position on the platforms, except that now the hands are no longer at the swimmer's side, but over his/her head (horizontally). From this position, the swimmer slides both hands medially off the platforms, bringing them together over his/her head for a streamlined push-off.

After mastering the "kick in" drill, the swimmer advances to a "swim in" drill where just as the swimmer's first arm stroke enters into the area between the platforms, the swimmer takes one last arm pull and, while gliding toward the wall with both arms at their side, the swimmer rotates the palms outwardly, palms-down, positioning them over and onto the hand platforms, repeating the tuck, flip and push off as described above.

With reference now to FIG. 1, a representative portion of a teaching aid is illustrated that enables swimmers to develop correct mechanics and movement patterns of a swimming flip turn in accordance with an embodiment of the present invention. The teaching aid of FIG. 1 includes a floatation mechanism 10, a surface 12, and coupling mechanism 14 that couples surface 12 to floatation mechanism 10. In the illustrated embodiment, a coupling mechanism 16 selectively couples the teaching aid to a lane line. Floatation mechanism 10 provides buoyancy. Coupling mechanism 14 (e.g., a connecting structure of polymer or aluminum material) couples floatation mechanism 10 to a surface/platform 12 that is configured to receive the swimmer's hands for performance of the flip turn.

In some embodiments, the coupling mechanism 14 is filled with a gas, such as ambient air, or another gas. In other embodiments, the coupling mechanism includes at least some fluid, such as water or another fluid.

A corresponding second portion (not shown) is coupled to the other lane line of the swimming lane to provide the corresponding platforms/surfaces to be appropriately spaced for use. This allows the swimmer to use both portions when performing swimming flip turn.

In the illustrated embodiment, a coupling mechanism 16 couples float 10 to pool lane lines. In another embodiment a teaching aid is coupled to a pole or structure and held in place by a person standing on the deck of the pool. In another embodiment, a teaching aid is coupled to a surface of the swimming pool, such as the floor, a wall, etc.

Figure 2:
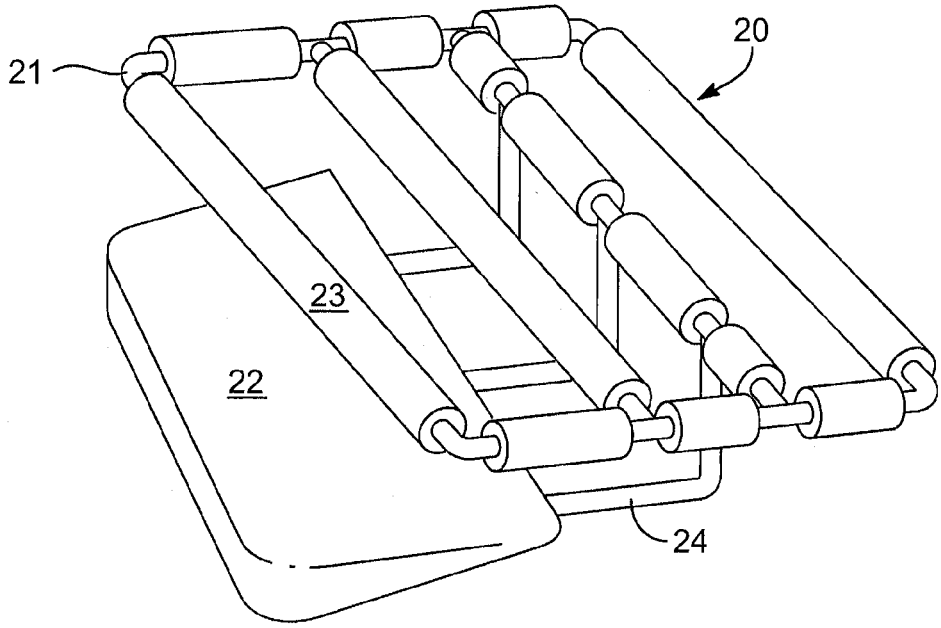
FIG. 2 illustrates another representative teaching aid that enables swimmers to develop correct mechanics and movement patterns of a swimming flip turn in accordance with an embodiment of the present invention.
Figure 3:
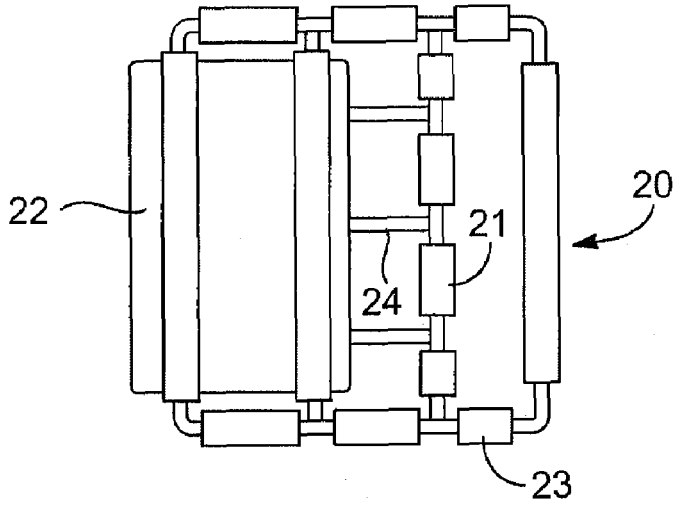
FIG. 3 is a top view of the representative embodiment of FIG. 2.

With reference now to FIG. 2, another embodiment is illustrated that enables swimmers to develop correct mechanics and movement patterns of a swimming flip turn in accordance with a representative embodiment of the present invention. In FIG. 2, the floatation mechanism 20 comprised of polyvinyl chloride ("PVC") pipe 21 with Styrofoam (polystyrene) sleeves 23 to which the hand platform 22 coupled by coupling mechanism 24. FIG. 3, illustrates a top view of the embodiment of FIG. 2.

In other embodiments, a floatation mechanism comprises an air-filed device, such as a hollow plastic cavity that is rotationally molded, or another type of buoyant device.

Figure 4:
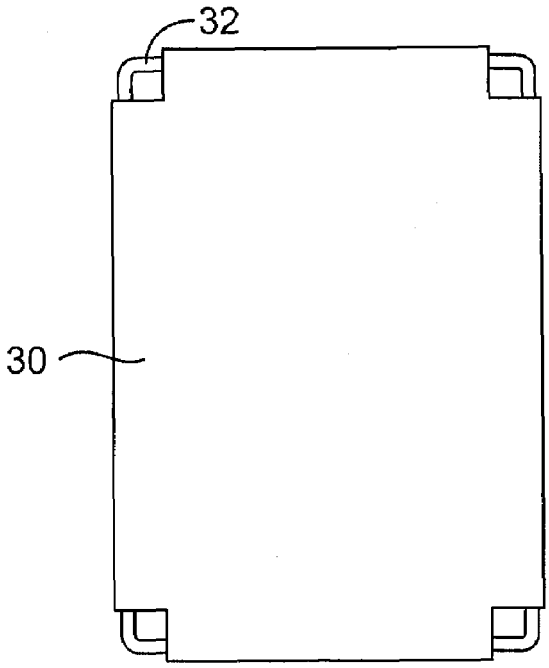
FIG. 4 is a representative surface or hand platform in accordance with a embodiment of the present invention.

With reference to FIG. 4, a representative hand platform in accordance with an embodiment of the present invention is illustrated. In FIG. 3, the hand platform is comprised of a plastic screen or other material 30 sewn or otherwise coupled to a supporting structure 32 to provide a surface for use by a swimmer. In another embodiment, the surface is a rigid surface for use by the swimmer.

Figure 5:
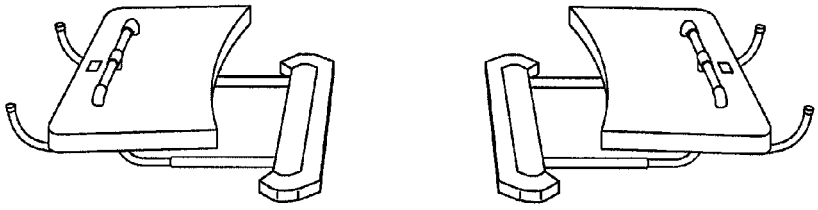
FIGS. 5-10 illustrate representative teaching aids that enable swimmers to develop correct mechanics and movement patterns of a swimming flip turn in accordance with representative embodiments of the present invention.
Figure 6:
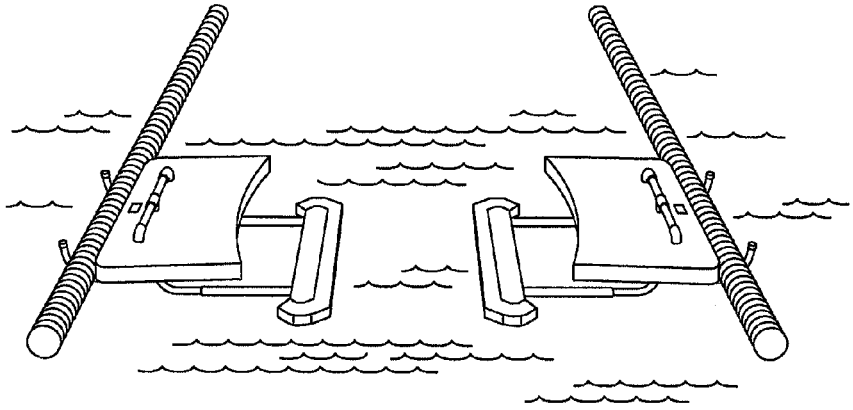

With reference now to FIGS. 5-13, representative teaching aids and utilization thereof to enable swimmers to develop correct mechanics and movement patterns of a swimming flip turn in accordance with a representative embodiment of the present invention are illustrated. In FIGS. 5-6, the teaching aid includes two portions that each provides a surface for use by the swimmer. The set of surfaces are appropriately spaced to allow a swimmer to perform a flip turn using both surfaces.

In the illustrated embodiment, a coupling mechanism includes a curve and is configured to receive a lane line (as illustrated in FIG. 6). The illustrated embodiment further includes a strap or other fastener that maintains the teaching aid coupled to the lane lines. The illustrated teaching aid is buoyant and rigid for use in performing a swimming flip turn.

Figure 7:
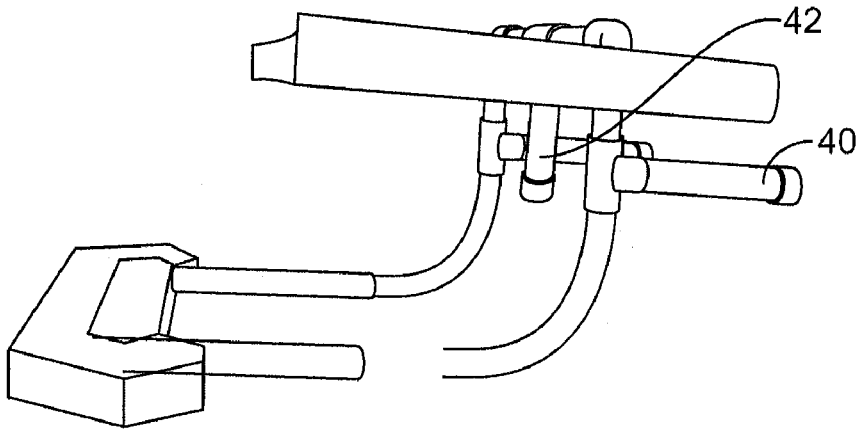

With reference now to FIG. 7, a representative teaching aid is illustrated, wherein a portion 40 of the structure extends out. Additionally, a handle 42 is provided to facilitate carrying/transporting the teaching aid.

Figure 8:
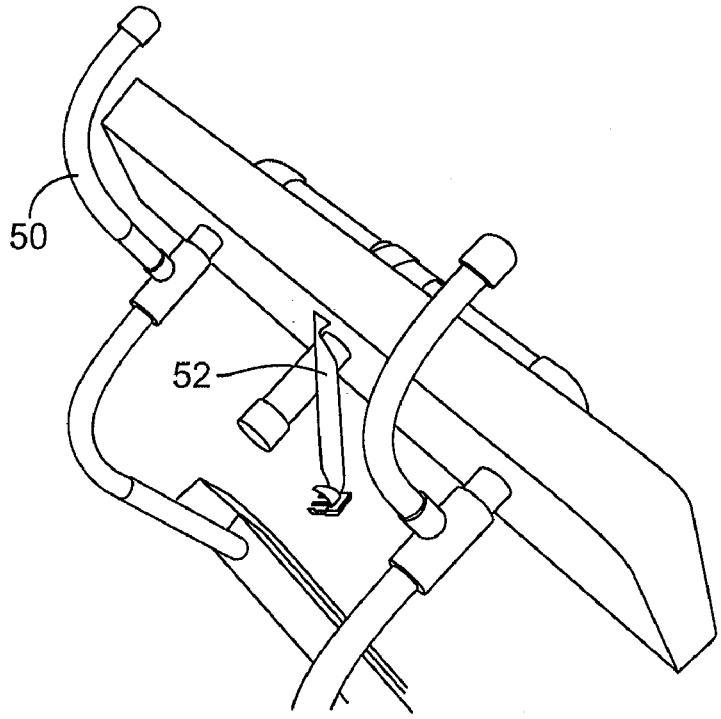

With reference to FIG. 8, a representative teaching aid is illustrated, wherein a portion 50 of the structure is configured to receive a lane line (not shown) and a fastener 52 ensures that the teaching aid does not escape the lane line when selectively coupled thereto.

Figure 9:
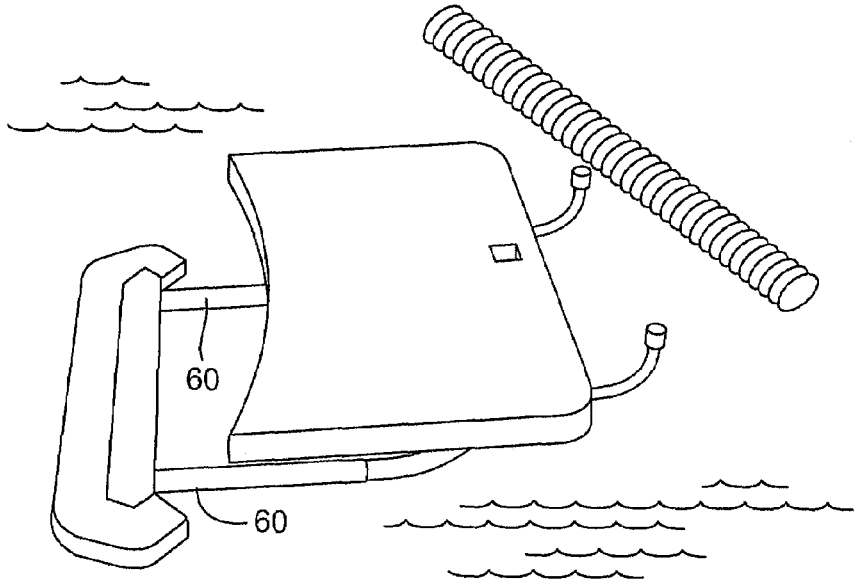
Figure 10:
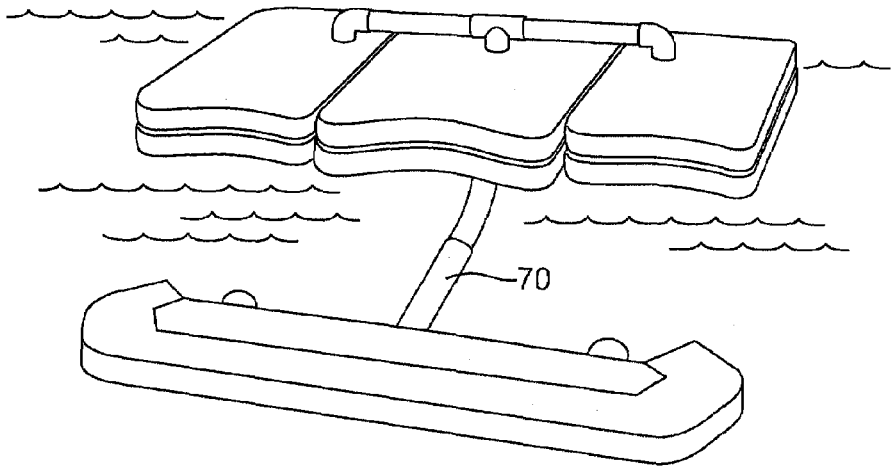

Embodiments of the present invention embrace a structure system that couples a platform to a floatation mechanism. By way of example, FIG. 9 illustrates an embodiment having two supports 60. Those skilled in the art will appreciate that embodiments of the present invention embrace more than two or less than two. For example, FIG. 10 illustrates an embodiment having a single support 70. With reference back to FIG. 2, an embodiment is illustrated having more than two supports.

In one embodiment, the teaching aid includes blocks that rest on or are coupled to the floor of the pool, and are at a depth in the water to allow for the top surfaces of the blocks to be used by the swimmer as a surface or platform for performing a flip turn.

In another embodiment, the teaching aid includes a base that rests on or is coupled to the floor of the pool, from which a hand platform or surface is extended for use in performing a flip turn.

Figure 11:
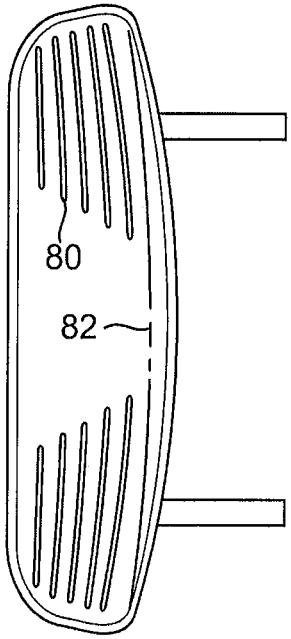
FIG. 11 is a top view of a representative surface or hand platform in accordance with an embodiment of the present invention.
Figure 12:
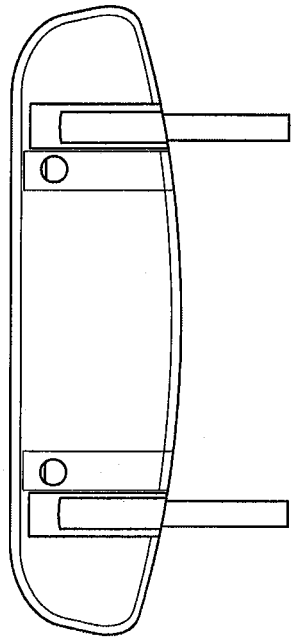
FIG. 12 is a bottom view of the representative surface or hand platform of FIG. 11.

With reference now to FIGS. 11-12, representative platforms are illustrated. FIG. 11 illustrates a top view of a representative platform and FIG. 12 illustrates a bottom view of a platform. In FIG. 11, the platform includes channels 80 and side wall 82. Channels 80 provide a texture for the swimmer, who is able to feel the orientation of the platform based on feeling channels 80. Similarly, side wall 82 provides maintains the swimmer's hand and/or arm on the platform and allows the swimmer to feel the orientation of the platform based on feeling side wall 82.

Figure 13A:
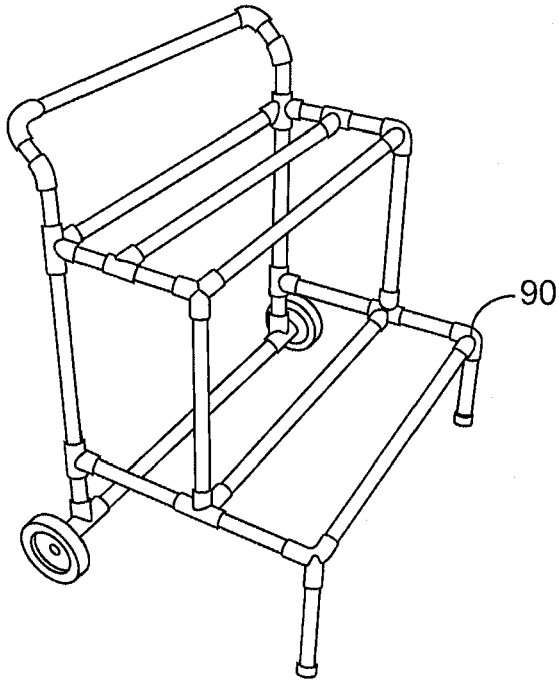
FIGS. 13A-13C illustrate a storage mechanism that is configured to receive a nested teaching aid for storage.
Figure 13B:
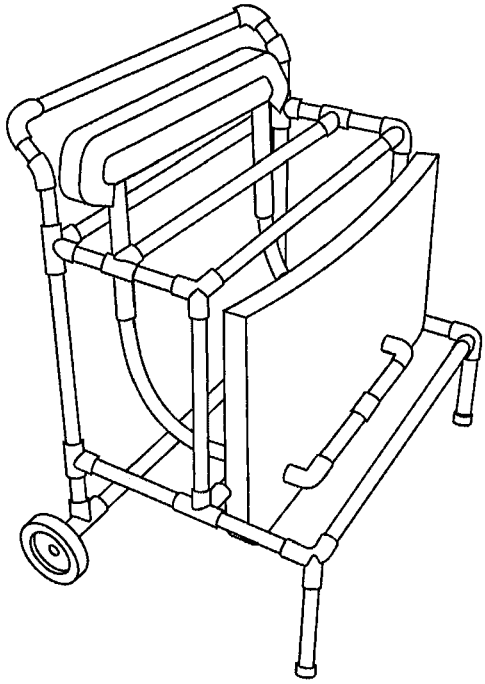
Figure 13C:
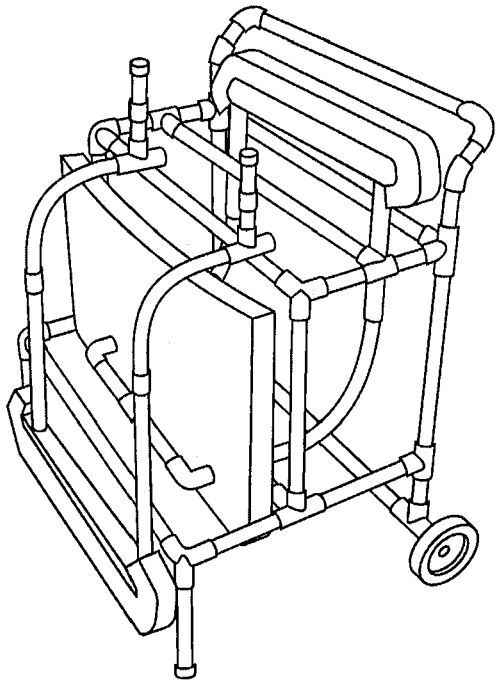

With reference to FIGS. 13A-13C, a storage device is illustrated that is configured to receive one or more teaching aids when not in use. FIG. 13 illustrates a representative storage mechanism/cart 90 that is configured to receive a teaching aid for storage. FIG. 13B illustrates a first portion of a teaching aid in storage cart 90. FIG. 13C illustrates a both portions of a teaching aid in storage cart 90. Thus, in the illustrated embodiments, the teaching aid portions are inter-nested and received by storage cart 90. In the illustrated embodiment, the storage cart includes wheels to facilitate moving the teaching aid as needed.

Figure 14:
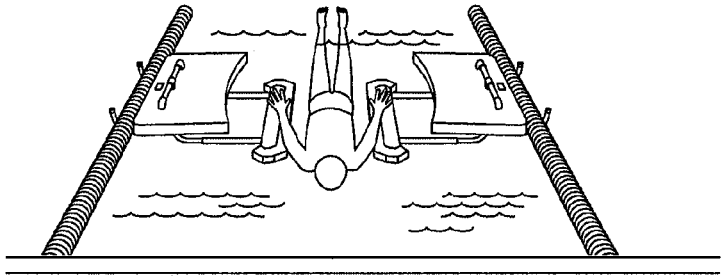
FIGS. 14-16 illustrate a representative method for developing correct mechanics and movement patterns of a swimming flip turn in accordance with an embodiment of the present invention.
Figure 15:
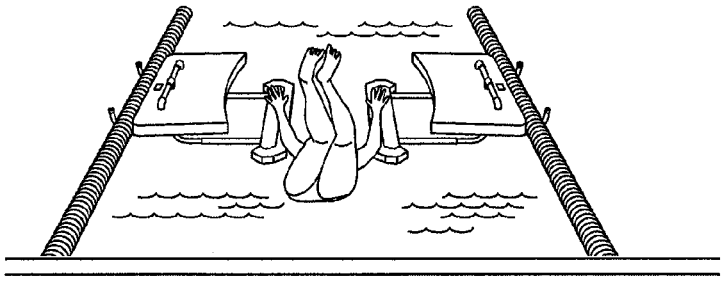
Figure 16:
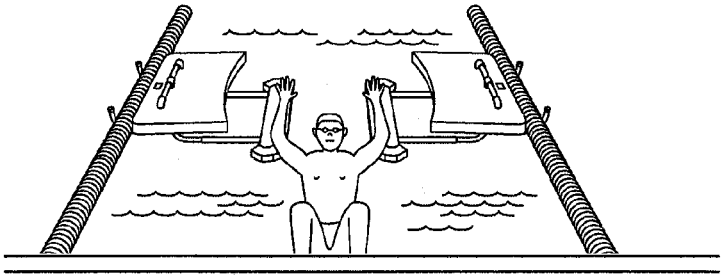

With reference now to the series of FIGS. 14-16, a representative method is illustrated for developing correct mechanics and movement patterns of a swimming flip turn in accordance with a representative embodiment of the present invention. In FIG. 14, a swimmer is shown who has "entered" the receiving area of a representative teaching aid after taking his/her final stroke, with both arms at his/her side, palms down and placed on the hand platforms or other surface area. In FIG. 15, the swimmer has initiated the flip turn by tucking his/her head while subsequently pressing his/her hands into the hand platforms continuously while lifting hips and legs out of the water. In FIG. 16, the swimmer has just completed the "flip" portion of the flip turn, positioned on his/her back, feet on the wall, knees bent and hands still positioned on the hand platforms, just prior to moving both hands medially overhead and pushing off.

Figure 17:
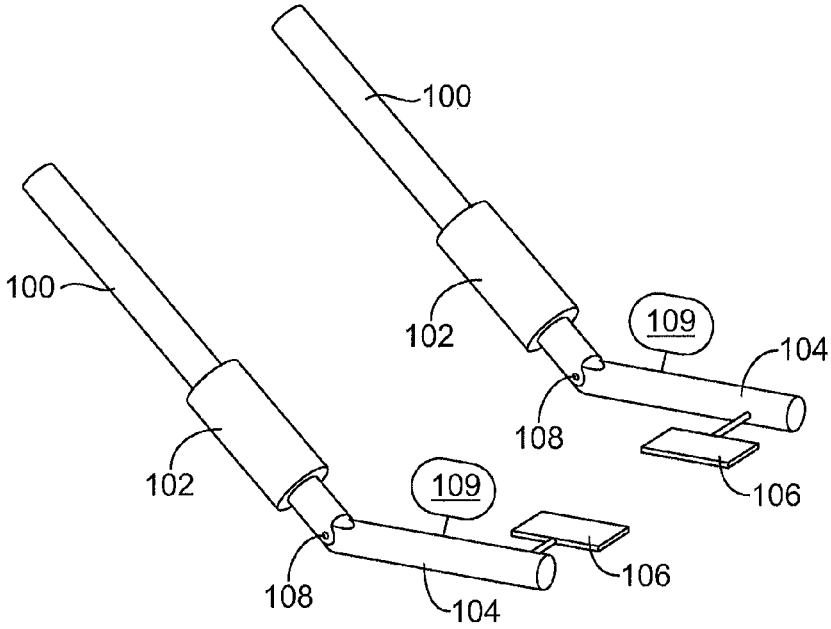
FIG. 17 illustrates a perspective view of another teaching aid that enables swimmers to develop correct mechanics and movement patterns of a swimming flip turn in accordance with an embodiment of the present invention.
Figure 18:
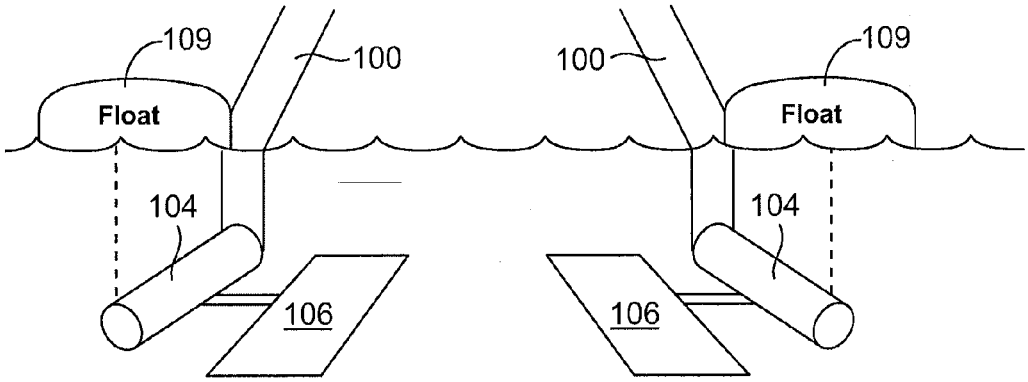
FIG. 18 illustrates a front view of the representative teaching aid of FIG. 17.

With reference now to FIG. 17, a perspective view of another teaching aid that enables swimmers to develop correct mechanics and movement patterns of a swimming flip turn in accordance with another representative embodiment of the present invention is illustrated. FIG. 17 is a side view of the teaching aid and FIG. 18 is a front view of the hand held teaching aid, which includes two poles 100 (e.g., aluminum pole, polymer pole, or other pole) that when held and lowered into the water from the edge of the pool rest against the edge of the pool on urethane sleeves 102. A separate and additional pole 104 with hand platforms 106 affixed is coupled to each pole 100 via a pin joint 108. Floats 109 attached by string, cord or rope to poles 104 to locate hand platforms 106 to a desired depth while the person holding poles 100 positions them at a distance from the edge and at a distance apart appropriate for the swimmer to use. In a further embodiment, the cord is adjustable to adjust the depth of the teaching aid into the water.

Figure 19:
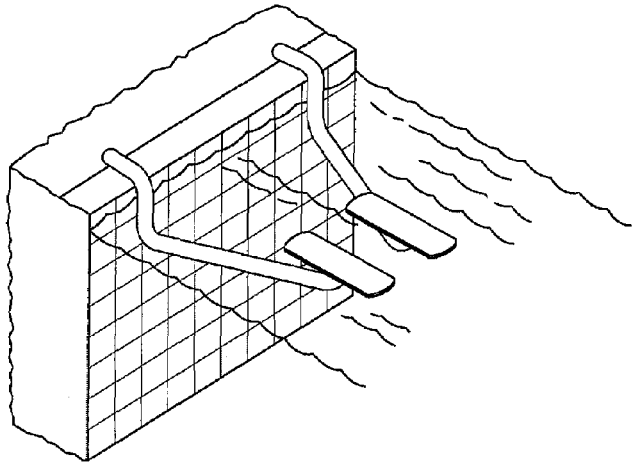
FIG. 19 illustrates a perspective view of another teaching aid that enables swimmers to develop correct mechanics and movement patterns of a swimming flip turn in accordance with an embodiment of the present invention.

With reference now to FIG. 19, a perspective view of another teaching aid that enables swimmers to develop correct mechanics and movement patterns of a swimming flip turn in accordance with another representative embodiment of the present invention is illustrated. In FIG. 19, the teaching aid is coupled to the lane line anchors on the edge of the pool, with arms extending to present the hand platforms at the appropriate depth and position to assist with the development of a proper swimming flip turn.

Figure 20:
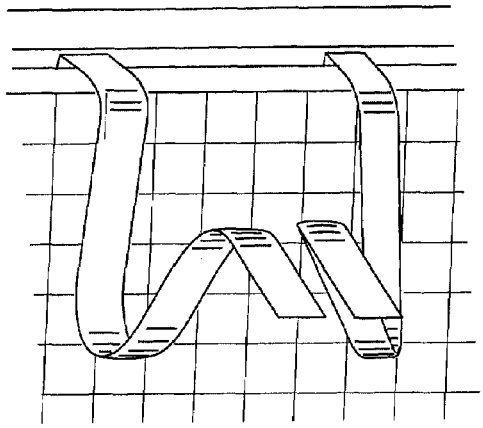
FIG. 20 illustrates a perspective view of another teaching aid that enables swimmers to develop correct mechanics and movement patterns of a swimming flip turn in accordance with an embodiment of the present invention.

FIG. 20 illustrates a perspective view of another teaching aid that enables swimmers to develop correct mechanics and movement patterns of a swimming flip turn in accordance with another representative embodiment of the present invention. In FIG. 20, ribbon or band-shaped arms couple to the gutter of the pool and provide hand platforms to the swimmer.

Figure 21:
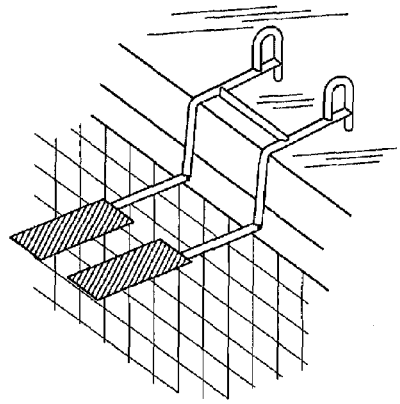
FIG. 21 illustrates a perspective view of another teaching aid that enables swimmers to develop correct mechanics and movement patterns of a swimming flip turn in accordance with an embodiment of the present invention.

FIG. 21 illustrates a perspective view of another teaching aid that enables swimmers to develop correct mechanics and movement patterns of a swimming flip turn in accordance with another representative embodiment of the present invention. In FIG. 21, another deck-secured embodiment shows a teaching aid coupled via holes drilled into the deck of the pool wherein the teaching aid can be secured, with arms extending to present hand platforms. In a further embodiment, suction cups are used to removably secure the teaching aid to the pool deck.

Figure 22:
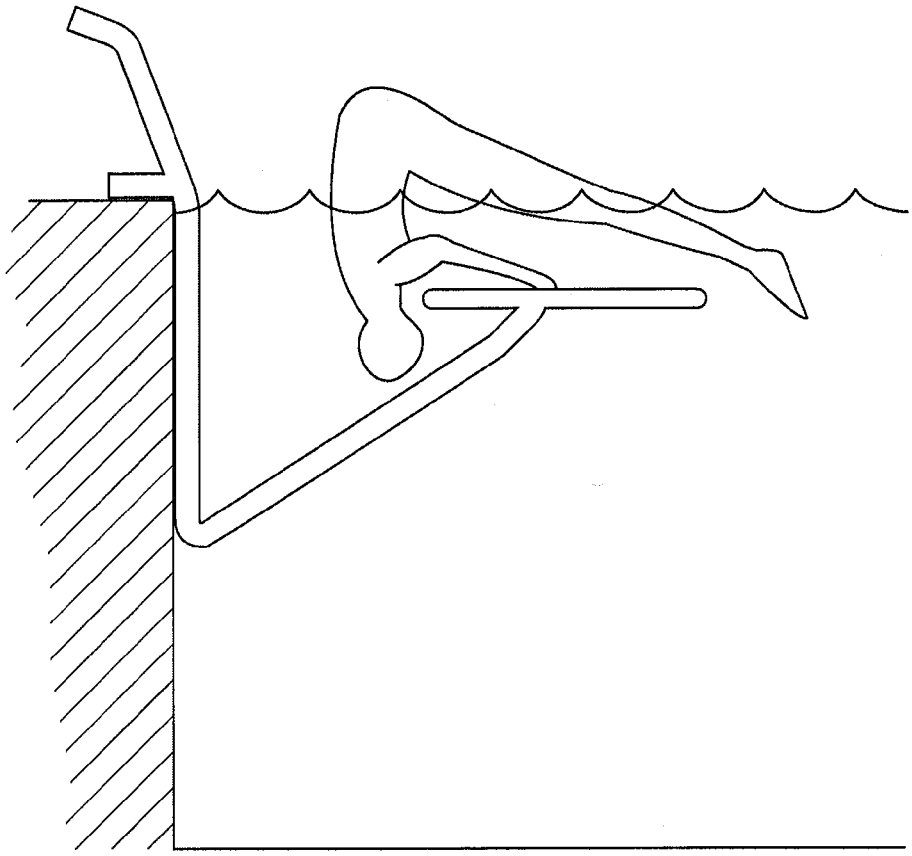
FIG. 22 illustrates another representative method for developing correct mechanics and movement patterns of a swimming flip turn in accordance with a representative embodiment of the present invention.

FIG. 22 illustrates another representative method for developing correct mechanics and movement patterns of a swimming flip turn in accordance with a representative embodiment of the present invention. In FIG. 22, a side view is provided of a swimmer implementing proper mechanics of a swimming flip turn with the assistance of hand platforms provided by a representative swimming flip turn teaching aid in accordance with an embodiment of the present invention.

Figure 23:
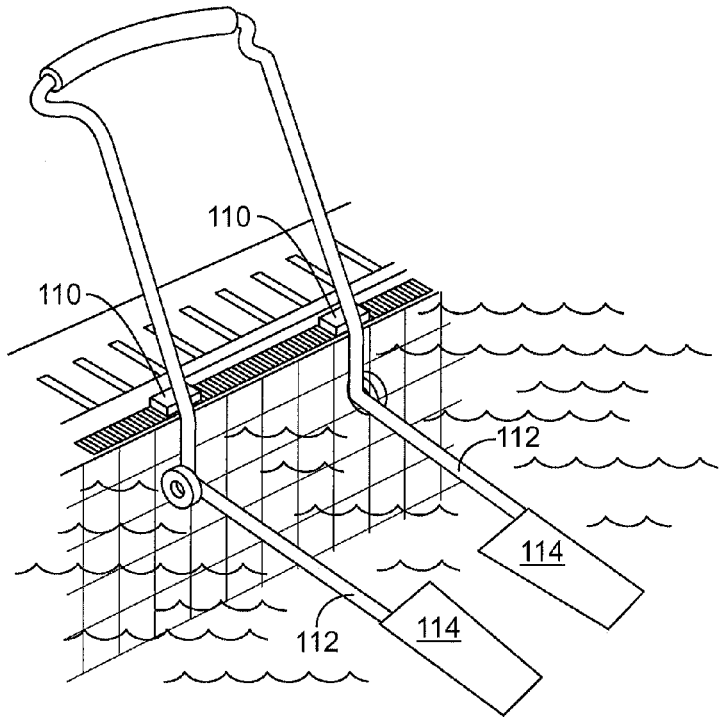
FIGS. 23-25 illustrate a perspective view of another teaching aid that enables swimmers to develop correct mechanics and movement patterns of a swimming flip turn in accordance with another representative embodiment of the present invention.
Figure 24:
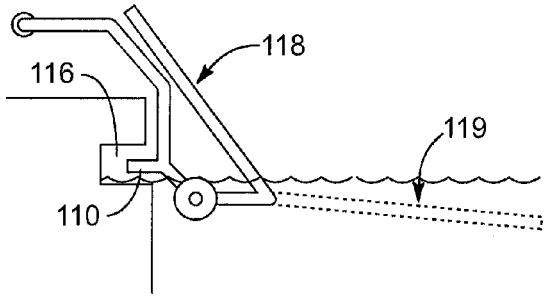
Figure 25:
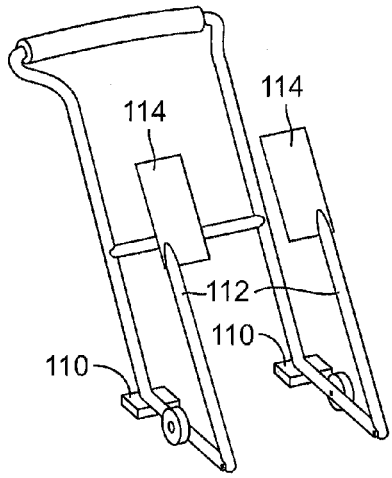
Figure 26:
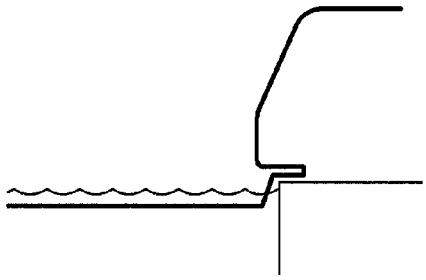
FIG. 26 illustrates a side view of a representative swimming pool structure and corresponding representative teaching aid for use in developing correct mechanics and movement patterns of a swimming flip turn in accordance with a representative embodiment of the present invention.
Figure 27:
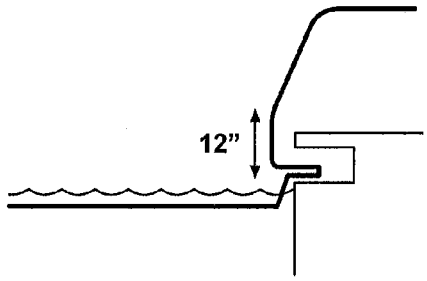
FIG. 27 illustrates a side view of another representative swimming pool structure and corresponding representative teaching aid for use in developing correct mechanics and movement patterns of a swimming flip turn in accordance with another representative embodiment of the present invention.
Figure 28:
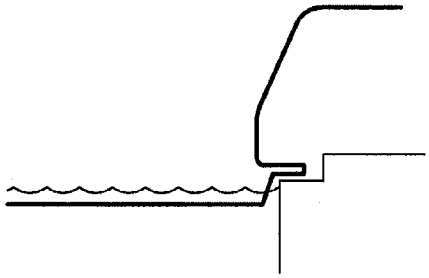
FIG. 28 illustrates a side view of another representative swimming pool structure and corresponding representative teaching aid for use in developing correct mechanics and movement patterns of a swimming flip turn in accordance with another representative embodiment of the present invention.
Figure 29:
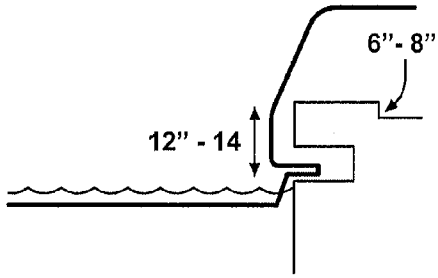
FIG. 29 illustrates a side view of another representative swimming pool structure and corresponding representative teaching aid for use in developing correct mechanics and movement patterns of a swimming flip turn in accordance with another representative embodiment of the present invention.

FIGS. 23-25 illustrate a perspective view of another teaching aid that enables swimmers to develop correct mechanics and movement patterns of a swimming flip turn in accordance with another representative embodiment of the present invention. In FIG. 23, a hand held version of a teaching aid is depicted that can be wheeled to and from the edge of the pool and folded (FIG. 25) for easier movement and storage when not in use. In FIG. 23, supporting structures 110 rest against the edge of the pool for support of the device while arms 112 extend with receiving hand platforms/surfaces 114. In FIG. 24, a side view is provided to portray the embodiment of FIG. 23 used in association with another type of pool design to allow supporting structures 110 to be received by a pool gutter 116. FIG. 24 further includes arms in a folded position 119 when not in use and in an extended position 119 for use of the teaching aid.

FIGS. 26-29 illustrate side views of representative swimming pool structures and corresponding representative teaching aid for use in developing correct mechanics and movement patterns of a swimming flip turn. In FIGS. 26-29, side views of a hand held embodiment demonstrate how a particular profile design may be used with the four most prevalent pool gutter designs.

Figure 30:
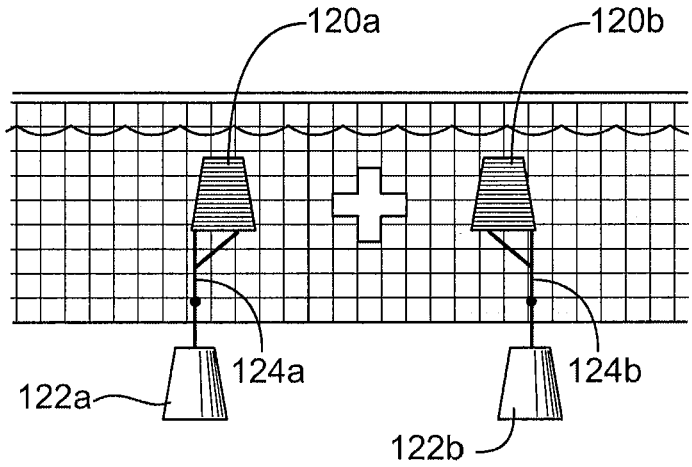
FIGS. 30-31 illustrate another representative embodiment for use in developing correct mechanics and movement patterns of a swimming flip turn in accordance with an embodiment of the present invention.
Figure 31:
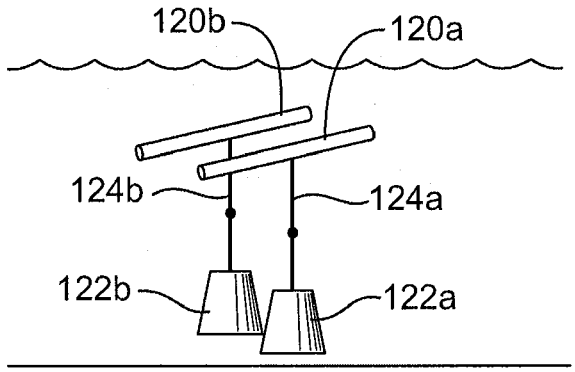

With reference now to FIGS. 30-31, another representative embodiment is illustrated. In the illustrated embodiment, surface areas or platforms 120 are provided so as to receive the arms of a swimmer for use in performing a swimming flip turn. Platforms 120 are coupled to non-buoyant feet 122 by an adjustable connecting mechanism 124. In the illustrated embodiment, the connecting mechanism is adjustable to place the platforms at the optimal swimming depth for utilization.

Those skilled in the art will appreciation that while some embodiments of the present invention are adjustable, while other embodiments of the present invention are fixed. Additionally, those skilled in the art will appreciate that embodiments of the present invention embrace a variety of structures and/or materials.

Figure 32:
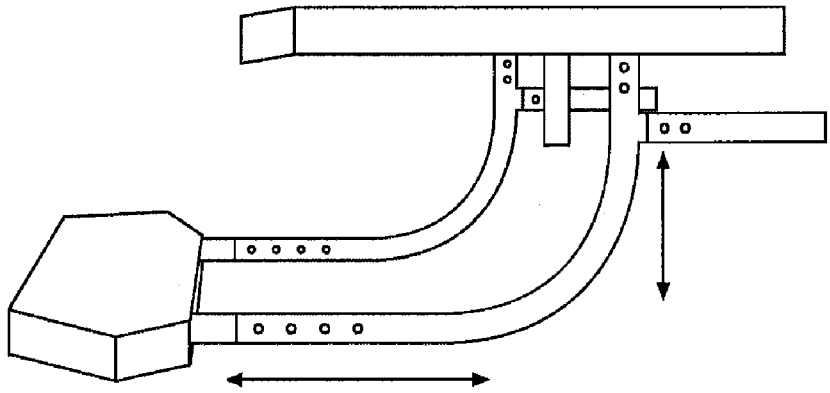
FIG. 32 illustrates a representative embodiment for use in developing correct mechanics and movement patterns of a swimming flip turn, wherein the embodiment is adjustable with respect to the water depth, the lane line width, and the lane line size.

At least some embodiments of the present invention embrace being adjustable with respect to the water depth, the lane line width and/or the lane line size. For example, with reference to FIG. 32, a representative teaching aid for use in developing correct mechanics and movement patterns of a swimming flip turn is illustrated, wherein the embodiment is adjustable with respect to the water depth, the lane line width and/or the lane line size. In particular, the illustrated embodiment includes telescoping structures having spring clips, snap buttons, pins, or the like. Accordingly, the teaching aid is selectively adjusted to a particular water depth, swimmer size, lane line width, and/or lane line size.

Figure 33:
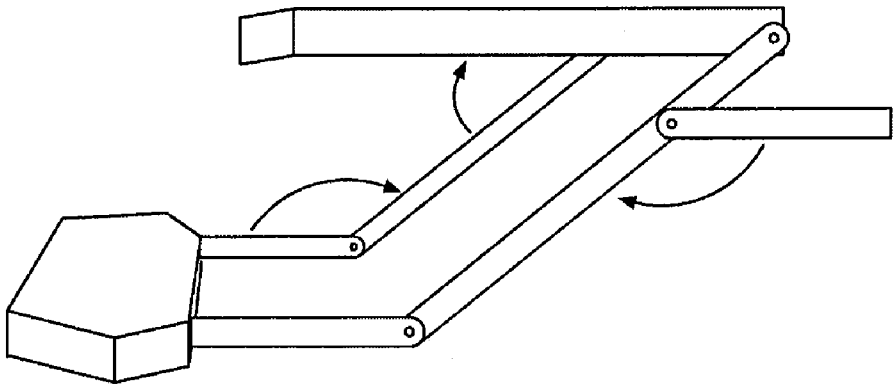
FIG. 33 illustrates a representative embodiment for use in developing correct mechanics and movement patterns of a swimming flip turn, wherein the embodiment is selectively collapsible.

With reference now to FIG. 33, a representative embodiment of the present invention for use in developing correct mechanics and movement patterns of a swimming flip turn is illustrated. In particular, hinge pins are provided to allow for the structures of the teaching aid to be adjusted for a particular water depth, lane line width and/or lane line size. Additionally, the hinge pins allow the teaching aid to transition between a use position and a storage position. Thus, the illustrated embodiment is selectively collapsible or foldable.

The representative embodiments discussed above and illustrated in the corresponding figures are representative of various embodiments of the present invention. Those skilled in the art will appreciate that embodiments of the present invention can comprise any material, configuration and/or component that provides the approximate form, shape, support and/or functionality as described herein to allow a swimmer to feel the proper mechanics of a flip turn.

In at least some embodiments, a teaching aid of the present invention includes buoyancy and rigidity to enable use thereof in performing a swimming flip turn. In some embodiments, a teaching aid is coupled to a pool structure, such as a wall, floor, lane line, etc. In some embodiments, a teaching aid is removable. In some embodiments a teaching aid is manipulated by an instructor outside of the swimming pool. In some embodiments, a teaching aid floats on the water, from which hand platforms or surface areas are coupled and extended to the proper depth and position for use in developing a proper flip turn.

In one embodiment, two platforms or surface areas are positioned into a swimming pool at a distance (i.e., approximately 3-6 feet) from the edge of the pool, at a shallow water depth (i.e., approximately 9-12 inches), and at a distance apart (i.e., approximately 18-25 inches apart). The surface areas are positioned so that they maintain such general positioning to allow swimmers to utilize the surface areas for performing flip turns. Those skilled in the art will appreciate that the distances and depths referenced above are illustrative in nature, and that embodiments of the present invention embrace distances and/or depths that are less than or greater than those provide above.

In one embodiment, the teaching device is affixed to the pool edge with arms extending to a teaching position. The arms of the device include the platforms or surface areas, which are used to allow the swimmer to bias against when performing the flip turn.

In another embodiment, the surface areas are part of corresponding arms of a portable teaching device that is easily moved to the edge of the pool or manually held and leveraged from the pool deck/edge. The arms extend to the teaching position to allow utilization thereof when performing a flip turn.

In another embodiment, the teaching device is a floating device to which surface areas or platforms are connected and positioned to a teaching or usable position. In a further embodiment, the floating device couples to the lane ropes of the swimming pool.

The dimensions and shapes of the surface areas or platforms can vary. The embodiments provide suitable support and surface area for the palms of a swimmer's hands to be placed on while pushing or biasing downward for support (one platform for each hand) as he or she initiates and executes a flip turn.

In at least some embodiments, the teaching aid or device is a tool that assists in teaching proper flip turn mechanics and includes such advantages as not requiring the coach or instructor to be in the water, not requiring the coach or instructor to hold the device while in use, and not requiring that the coach or instructor to be of large enough physical stature to implement such a hands on teaching strategy, allowing the swimmer to practice the proper mechanics on his/her own, and allowing the swimmer to press down on a fixed object or surface area with open hands simulating the press down on the water that is performed when executing a proper flip turn.

Embodiments of the present invention enable coaches to instruct and swimmers to develop a swimming flip turn that includes a proper distance from the wall to initiate the turn, proper depth to maintain while performing the turn, proper arm and hand use/positioning while executing the turn and a proper push-off that is streamlined and perpendicular to the wall, which are mechanics of executing a flip turn and are difficult aspects of the flip turn to teach and to learn.

Utilization of embodiments of the present invention contributes to teaching and learning the flip turn mechanics and therefore significantly reduces the amount of time required to teach or learn a proper flip turn. In accordance with embodiments of the present invention, proper distances from the wall to initiate the flip turn are developed, swimmers are maintained at a proper depth while executing a flip turn, proper positioning of arms and hands are developed, and/or an understanding of what to do with the swimmer's arms and hands as the swimmer initiates and completes the flip turn is developed, namely pressing down with their hands as they lift their hips and legs out of the water and not allowing the hands to go off in any direction that would inhibit a proper "flip" and a quick and streamlined push-off.

Utilization of embodiments of the present invention further provides the support a swimmer needs to successfully execute and feel the proper mechanics of a flip turn before the swimmer has actually learned how to do one on his/her own, allows the swimmer to develop kinesthetic sense or muscle memory for the correct mechanics of a flip turn, eliminates the need for the coach or instructor to get into the water and move the swimmer through the proper mechanics of the turn, encourages a straight-line push off at a right angle to the wall, helps the swimmer identify where the pivotal point of the flip turn is and provides a tangible reference point for spatial orientation while the swimmer is "flipping" in the water, and reduces teaching and learning time for proper execution of the flip turn.

Thus, as discussed herein, embodiments of the present invention embrace developing correct mechanics of a swimming flip turn. In particular, the present invention relates to systems and methods for providing and using a teaching aid that enables swimmers to develop correct mechanics and movement patterns of a flip turn that is used, for example, in freestyle and backstroke swimming events.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An teaching aid for use in developing correct mechanics of a swimming flip turn, the teaching aid comprising:

a plurality of surface areas that are each at least as wide as a swimmer's hand width, wherein the surface areas are spaced a distance apart and located at a water depth from a top surface of the water to allow the swimmer to perform a swimming flip turn therebetween while the swimmer is in contact with the surface areas, the surface areas each being configured to receive a portion of the swimmer's hand for at least one of (i) support, (ii) tactile feedback and (iii) spatial orientation as the swimmer performs the swimming flip turn.

2. The teaching aid as recited in claim 1, wherein the distance is adjustable to at least one of: (i) individual swimmers; (ii) a lane line width; (iii) a lane line size; and (iv) a particular water depth.

3. The teaching aid as recited in claim 2, wherein the surface areas are adjustable to varying water depths from the top surface of the water.

4. The teaching aid as recited in claim 3, wherein the teaching aid is selectively foldable.

5. The teaching aid as recited in claim 1, wherein the surface areas are coupled to corresponding lane lines.

6. The teaching aid as recited in claim 1, wherein the surface areas are coupled to a floor of a swimming pool.

7. The teaching aid as recited in claim 1, wherein the surface areas are coupled to a deck of a swimming pool.

8. The teaching aid as recited in claim 1, wherein the teaching aid is configured to be held by an instructor while in use by the swimmer.

9. The teaching aid as recited in claim 1, further comprising floatation mechanisms and coupling mechanisms, the coupling mechanisms coupling the floatation mechanisms to the corresponding surface areas.

10. The teaching aid as recited in claim 9, wherein the coupling mechanisms comprise a polymer structure.

11. The teaching aid as recited in claim 9, wherein the coupling mechanisms comprise an aluminum structure.

12. The teaching aid as recited in claim 9, wherein the floatation mechanisms comprise at least one of: (i) polystyrene; and (ii) an air-filled polymer.

13. The teaching aid as recited in claim 9, wherein the coupling mechanisms are configured to receive a corresponding lane line.

14. The teaching aid as recited in claim 13, further comprising one or more fastener mechanisms configured to couple the teaching aid to the corresponding lane line.

15. The teaching aid as recited in claim 1, wherein at least one surface area comprises a side wall.

16. The teaching aid as recited in claim 1, further comprising a storage device configured to receive the teaching aid when not in use.

17. The teaching aid as recited in claim 1, further comprising a handle coupled to at least one surface area.

18. A method of teaching mechanics of a swimming flip turn, the method comprising:

providing a teaching aid having a surface area configured to receive a portion of a swimmer's hand as the swimmer performs a swimming flip turn; and positioning the surface area at a particular water depth to enable the swimmer to use the surface area for at least one of (i) support, (ii) tactile feedback and (iii) spatial orientation as the swimmer performs a swimming flip turn.

19. The method as recited in claim 18, further comprising:

adjusting the teaching aid such that the particular water depth of the surface area is tailored to a particular swimmer.

20. A method for learning correct mechanics of a swimming flip turn, the method comprising:

approaching a receiving area of a teaching aid having a surface area that is located at a particular water depth and configured to receive a portion of a swimmer's hand as the swimmer performs a swimming flip turn; and using the surface area for at least one of (i) support, (ii) tactile feedback and (iii) spatial orientation during performance of a swimming flip turn.

* * * * *